US006323851B1

(12) United States Patent
Nakanishi

(10) Patent No.: US 6,323,851 B1
(45) Date of Patent: Nov. 27, 2001

(54) CIRCUIT AND METHOD FOR DRIVING DISPLAY DEVICE

(75) Inventor: Takayuki Nakanishi, Tachikawa (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 09/159,484

(22) Filed: Sep. 23, 1998

(30) Foreign Application Priority Data

Sep. 30, 1997 (JP) ..... 9-281161

(51) Int. Cl.[7] ..... G09G 5/00
(52) U.S. Cl. ..... 345/211; 345/204
(58) Field of Search ..... 345/204, 211, 345/212

(56) References Cited

U.S. PATENT DOCUMENTS 5,155,613 * 10/1992 Sakayori ..... 345/97
5,248,963 * 9/1993 Yasui et al. ..... 345/98
5,448,258 * 9/1995 Edwards ..... 345/90
5,453,757 * 9/1995 Date et al. ..... 345/89
5,493,685 * 2/1996 Zenda ..... 713/340
5,592,191 * 1/1997 Tsuboyama et al. ..... 345/97
5,793,163 * 8/1998 Okuda ..... 315/169.2

FOREIGN PATENT DOCUMENTS 08-220508A 8/1996 (JP) .
08-278481A 10/1996 (JP) .

* cited by examiner

*Primary Examiner*—Bipin Shalwala
*Assistant Examiner*—Ricardo Osorio
(74) *Attorney, Agent, or Firm*—Frishauf, Holtz, Goodman, Langer & Chick, P.C.

(57) ABSTRACT

To prevent irregular display such as bright lines or spots caused by power supply cut-off from appearing on a display screen.

A switch controller is driven with a voltage $V_{CH}$. During an on-state period, the switch controller divides charges in a charge carrier capacitor CC to boosting capacitors C2 to C4 to generate boosted voltages $V_2$ to $V_4$ each of which is higher than a source voltage $V_{DD}$. A signal drive circuit and a scan drive circuit select a voltage from the voltages $V_{DD}$ and $V_1$ to $V_4$, and the selected voltages are applied to a liquid crystal display device to drive it. When the power supply is cut off, the source voltage $V_{DD}$ is reduced. A source voltage detector detects the voltage drop and a switch SW9 is turned to on-state. The switch controller is driven with the charges in a capacitor CG and turns switches SW1 to SW8 to on-state. Thus, the capacitors CC and C1 to C4 are discharged, and all voltages from a power source circuit are ground voltages $V_{SS}$. As a result, the irregular display such as bright line or the like is prevented from occurring.

12 Claims, 9 Drawing Sheets

| INPUT | | | OUTPUT |
|---|---|---|---|
| Sa | Sb | Soff | |
| L | L | L | $V_{DD}$ |
| L | H | L | $V_2$ |
| H | L | L | $V_4$ |
| H | H | L | $V_2$ |
| L | L | H | $V_{DD}$ |
| L | H | H | $V_{DD}$ |
| H | L | H | $V_{DD}$ |
| H | H | H | $V_{DD}$ |

| INPUT | | | OUTPUT |
|---|---|---|---|
| Sc | Sd | Soff | |
| L | L | L | $V_{DD}$ |
| L | H | L | $V_3$ |
| H | L | L | $V_4$ |
| H | H | L | $V_1$ |
| L | L | H | $V_{DD}$ |
| L | H | H | $V_{DD}$ |
| H | L | H | $V_{DD}$ |
| H | H | H | $V_{DD}$ |

CIRCUIT AND METHOD FOR DRIVING DISPLAY DEVICE

BACKGROUND OF THE INVENTION

1. Field of the Invention

The present invention relates to a circuit and a method for driving a display device, more particularly to a circuit and a method for driving a display device which can prevent undesired bright lines or spots from appearing on a display screen when power supply is cut off 2. Description of the Related Art A display device is driven with a voltage which is higher than a source voltage supplied from a battery or the like. To obtain such a drive voltage, a drive circuit of the display device comprises a booster circuit for boosting a source voltage from a battery or the like up to a plurality of predetermined high voltages. The drive circuit has its power source circuit and it outputs a plurality of different voltages because the display device needs different voltages to its scanning electrodes and signal electrodes for time-sharing addressing.

A booster circuit or a dividing circuit is used as such a power source circuit which outputs a plurality of different voltages. The booster circuit boosts a source voltage into a plurality of different voltages. The booster circuit boosts a voltage by switching connection of a plurality of capacitors so that charged voltages in the capacitors are added to each other. The dividing circuit divides a previously boosted voltage into a plurality of different voltages. The dividing circuit divides a boosted source voltage with a series circuit of resistors or capacitors.

A capacitor-based booster or dividing circuit is advantageous to reduce its power consumption.

Each of output lines of the power source circuit has a plurality of capacitors in order to output stable voltages.

SUMMARY OF THE INVENTION

In a conventional drive circuit, charges remaining in capacitors on the drive circuit are supplied to a display device when the device is turned off and the supplied charges cause irregular bright spots or lines on a display screen.

For example, switch elements in the display device are in unstable state immediately after the device is turned off and some of them are in on-state irregularly. Charges in the capacitors are applied to the display device via thus activated switch elements. This causes the bright spots or lines which irregularly appear on the display screen. This unnecessary display is kept until the charges in the capacitors are almost discharged.

The present invention has been made in consideration of the above, and it is an object to prevent irregular display caused by power-off action of the device from occurring.

It is another object of the present invention to terminate activity of the display device without irregular display after the device is turned off.

To achieve the above objects, a driving circuit for a display device according to a first aspect of the present invention comprises: drive voltage generating means, to which electricity is supplied, for generating and outputting drive voltages for driving a display device;

drive means for driving the display device with the drive voltages from said drive voltage generating means; and power-off state detection means for detecting that the power supply to the drive voltage generating means is cut off, and for outputting a detection signal to at least one of the drive voltage generating means and the drive means so as to execute predetermined power-off processing for controlling the display device not to light.

According to thus structured present invention, at least one of the drive voltage generating means and the drive means executes predetermined processing which causes the display device not to be lit when the power supply to the drive voltage generating means is cut off. This prevents irregular bright lines or spots from appearing on the display device after the device is turned off.

In the case where the circuit for driving the display device further comprises charge means, it is preferable that at least one of the drive voltage generating means and the drive means executes the predetermined power-off processing with the electricity charged in the charge means.

According to this structure, the charges in the charge means are exhausted because they are used for executing the predetermined processing. Thus, the irregular display caused by the charges is prevented from occurring. Moreover, the charge means is native to there for driving the display device, therefore, additional preparation of the charge means is not required.

In order to prevent the irregular display after the power-off from occurring, the drive voltage generating means may comprise power-off processing means which generate and output in response to the detection signal from the power-off state detection means a plurality of voltages which cause the display device not to light.

The drive voltage generating means may comprise, for example, capacitors to which electricity is supplied and are charged with the supplied electricity, and control means for generating a plurality of drive voltages. which drive the display device with the voltages charged in the capacitors.

The control means may include discharge control means which discharge the capacitors in response to the detection signal from said power-off state detection means.

In this case, the discharge control means connect both terminals of each of the capacitors, or connect the both terminals of each of the capacitors via a resistive load.

The control means may fix a voltage of at least one terminal of each of the capacitors to a predetermined voltage in response to the detection signal from the power-off state detection means. Thus, the charges which cause the irregular display are eliminated.

In the case where the drive voltage generating means comprises boost means which boost supplied voltages and the boosted voltages are output as the drive voltages, the drive voltage generating means may comprise control means which controls in response to the detection signal from the power-off state detection means the boost means to terminate the outputs of the boosted voltages or to reduce the boosted voltages.

The drive voltage generating means may comprise dividing means which has boost means for boosting the supplied voltage and outputting the boosted voltage, and means for dividing the boosted voltage into a plurality of voltages and controlling the boost means to terminate the output of the boosted voltage in response to the detection signal from the power-off state detection means. In this case, the output of the divided voltages may be terminated.

The drive voltage generating means may comprise dividing means which has boost means for boosting the supplied voltage and outputting the boosted voltage, and means for dividing the boosted voltage into a plurality of voltages and controlling the boost means to reduce the boosted voltage in response to the detection signal from the power-off state detection means. In this case, the divided voltages may be reduced.

The drive means may comprise power-off processing means which generate in response to the detection signal from the power-off state detection means voltages which cause the display device not to light and supply the generated voltages to the display device.

In the case where the display device lights when a voltage which is applied between opposing two electrodes is equal to or greater than a threshold voltage, the drive means may apply a voltage which is smaller than the threshold voltage between the opposing two electrodes in the display device in response to the detection signal from the power-off state detection means. That is, the voltage which does not cause the display device to light is applied between the opposing two electrodes of the display device after the display device is turned off, thus, the display device is turned to be in non-display state. This prevents irregular bright lines or spots from appearing on the display device.

The drive voltage generating means may comprise means for reducing an externally supplied voltage when the power-off state detection means detects that the power supply is cut off.

A method for driving a display device with electricity charged in capacitors, according to a second aspect of the present invention comprises a step of executing predetermined processing for turning off the display device without occurrence of the irregular display while being powered by said capacitors with the charged electricity when it is detected that power supply is cut off.

Thus, termination processing such as discharging the charged electric energy, which causes the irregular display, in the capacitor, or applying drive voltages which cause the display device not to be lit is executed to terminate the display performance of the display device without occurrence of the irregular display.

DETAILED DESCRIPTION OF THE PREFERRED EMBODIMENT

A liquid crystal display apparatus according to an embodiment of the present invention will now be described with reference to the accompanying drawings.

Figure 1:
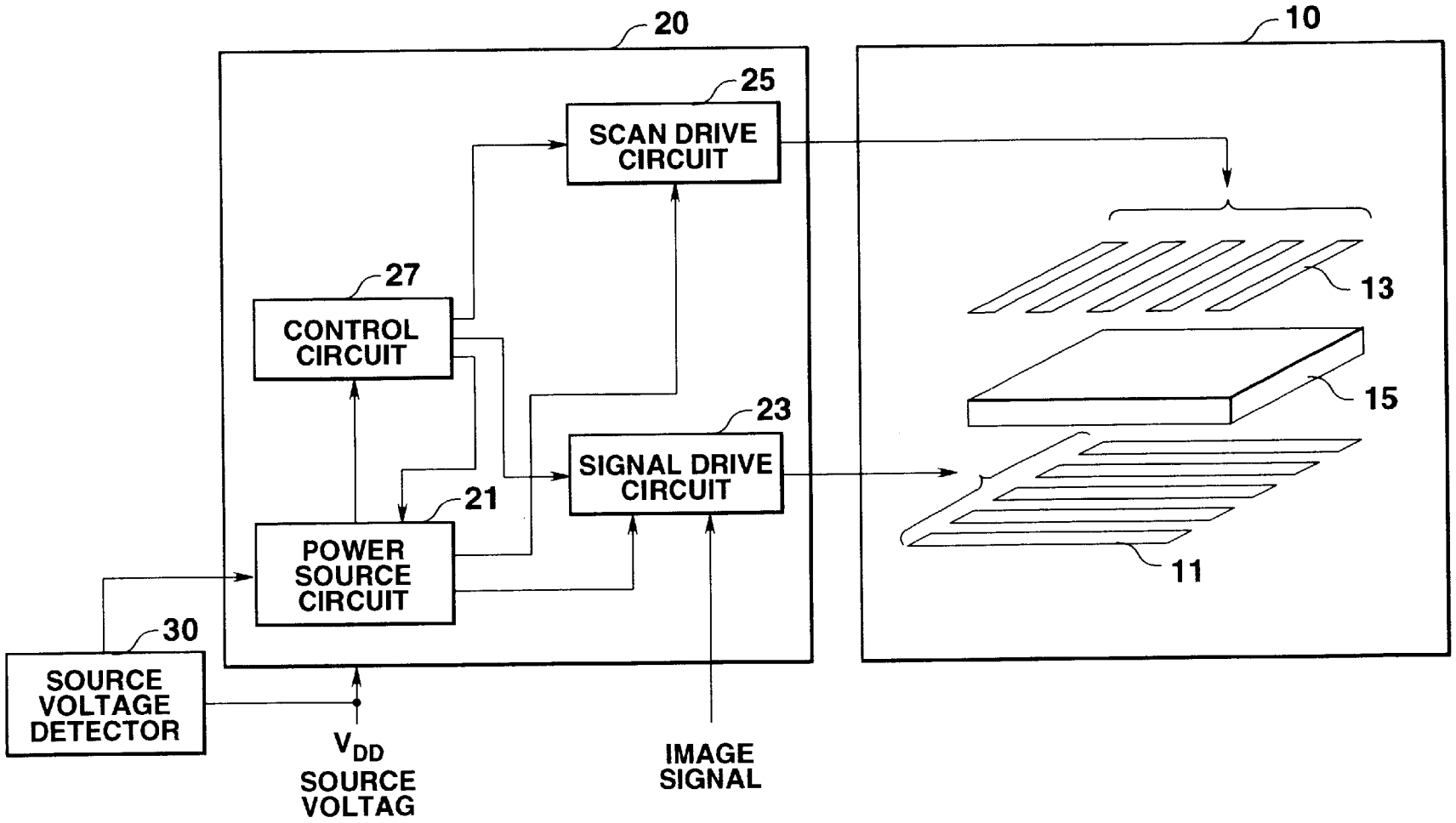
FIG. 1 is a block diagram showing the structure of a liquid crystal display apparatus according to an embodiment of the present invention.

As shown in FIG. 1, the liquid crystal display (LCD) apparatus comprises: a liquid crystal display (LCD) device 10; a drive control circuit 20 for driving the LCD device 10; and a source voltage detector 30 for detecting a source voltage to be supplied to the drive control circuit 20 and controlling the drive control circuit 20.

As schematically shown in FIG. 1, the LCD device 10 comprises: a signal electrode array 11; a scan electrode array 13; and a liquid crystal (LC) layer 15. The signal electrode array 11 comprises a plurality of signal (segment) electrodes. The scan electrode array 13 comprises a plurality of scan (common) electrodes which are arranged perpendicularly to the signal electrodes. The LC layer 15 is provided between the signal electrode array 11 and the scan electrode array 13. Display on the LCD device 10 is performed in accordance with voltages applied between the signal electrode array 11 and the scan electrode array 13.

The drive control circuit 20 is provided for driving and controlling the LCD device 10. As schematically shown in FIG. 1, the drive control circuit 20 comprises: a power source circuit 21; a signal drive circuit 23; a scan drive circuit 25; and a control circuit 27. The power source circuit 21 generates and outputs a plurality of voltages. The signal drive circuit 23 selects the plurality of voltages from the power source circuit 21 and supplies a signal voltage to the plurality of signal electrodes 11 in the LCD device 10. The scan drive circuit 25 selects the plurality of voltages from the power source circuit 21 and supplies a scan voltage to the plurality of scan electrodes 13 in the LCD device 10. The control circuit 27 supplies a plurality of timing control signals to the above described circuits. The drive control circuit 20, for example, is an LSI (Large Scale Integrate) including those circuits.

Figure 2:
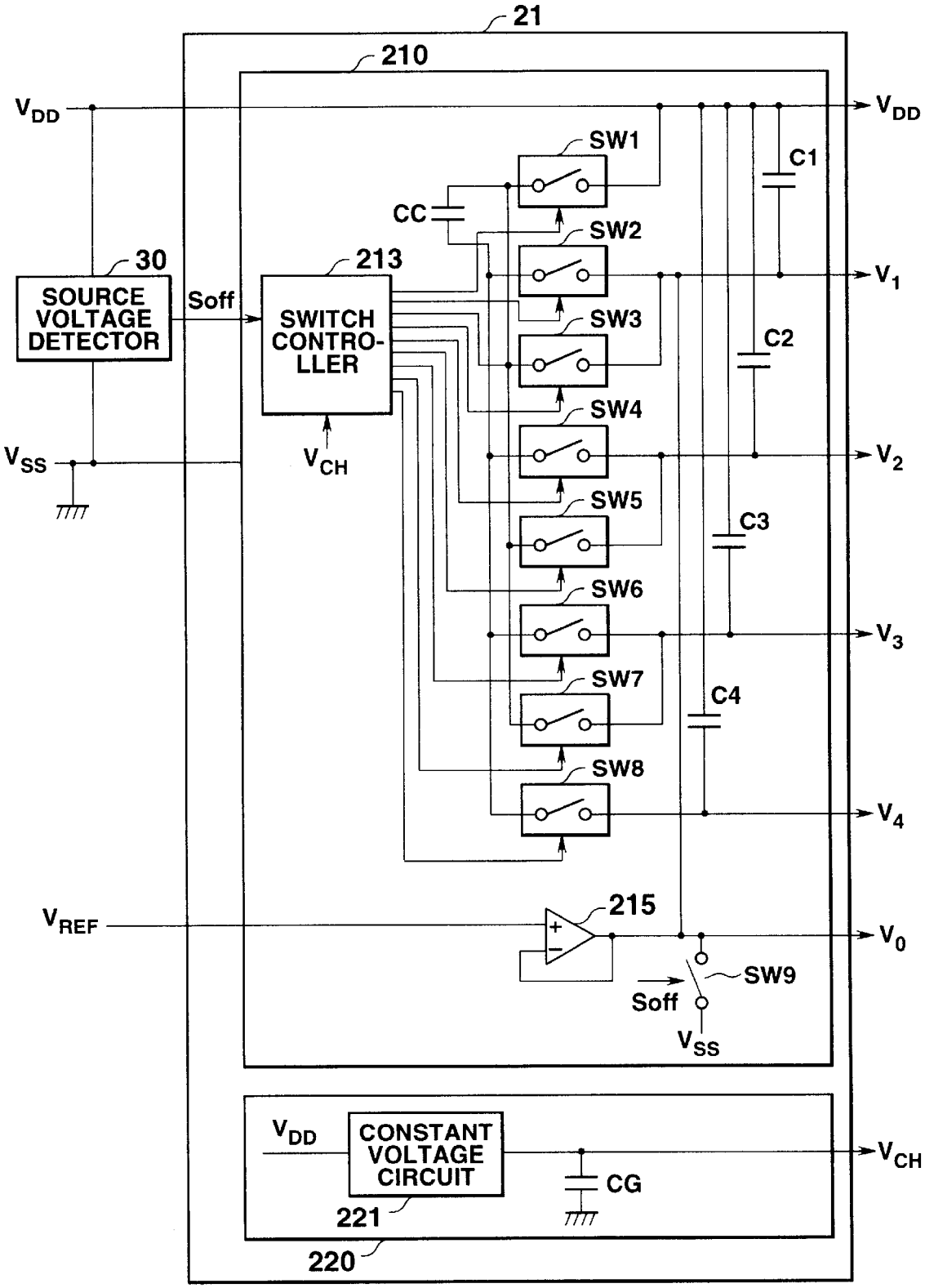
FIG. 2 is a block diagram showing the structure of a power source circuit shown in FIG. 1.

As shown in FIG. 2, the power source circuit 21 comprises: a booster circuit 210; and a low voltage circuit 220. The booster circuit 210 boosts the supplied source voltage to generate a plurality of voltages. The low voltage circuit 220 generates an operational voltage for operating the logical circuits such as the signal drive circuit 23, the scan drive circuit 25 and the power source circuit 21.

The booster circuit 210 receives the electric power and generates voltages for driving the LCD device 10. As shown in FIG. 2, the booster circuit 210 comprises: a switch controller 213; switches SW1 to SW9; boosting capacitors C1 to C4; a charge carrier capacitor CC; and a voltage follower amplifier 215. The switch controller 213 outputs signals for controlling a plurality of switches in predetermined order. The switches SW1 to SW9 are opened or closed in accordance with the signals from the switch controller 213. The connection of the boosting capacitors C1 to C4 is switched by the switches SW1 to SW9. The voltage follower amplifier 215 receives an externally supplied reference voltage $V_{REF}$ and outputs a voltage $V_0$ for charging the capacitors C1 to C4 and CC. The booster circuit 210 outputs a voltage $V_1$ which is equal to the reference voltage $V_{REF}$ and voltages $V_2$ to $V_4$ which are obtained by boosting the source voltage $V_{DD}$ ($V_4>V_3>V_2>V_{DD}>V_1$).

Figure 3:
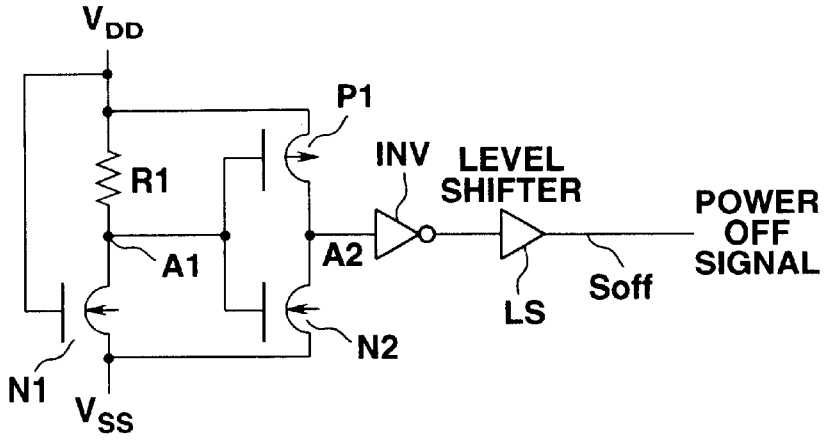
FIG. 3 is a circuit diagram showing a source voltage detection circuit shown in FIG. 1.

The source voltage detector 30 detects the potential difference between the externally supplied source voltage $V_{DD}$ and a ground voltage $V_{SS}$, and outputs a power off signal. FIG. 3 exemplifies the structure of the source voltage detector 30. The source voltage detector 30 outputs a high-level power off signal $S_{off}$ when the level of the externally supplied source DC voltage $V_{DD}$ (more precisely, $V_{DD}-V_{SS}$) is lower than predetermined level.

In the circuit shown in FIG. 3, an N-channel MOS transistor N1 is turned on when the voltage $V_{DD}-V_{SS}$ is higher than a threshold voltage of the N-channel MOS transistor N1. As a result, a voltage at a node A1 between a resistor R1 and the drain of the N-channel MOS transistor N1 is almost equal to the ground voltage $V_{SS}$. Then, a P-channel MOS transistor P1 is turned on and an N-channel MOS transistor N2 is turned off. A high-level voltage appears at a node A2 between the P-channel MOS transistor P1 and the N-channel MOS transistor N2. As a result, an inverter INV outputs a low-level voltage and a level shifter LS shifts the level of the low-level voltage.

When the source voltage $V_{DD}$ is reduced by power supply cut-off, the voltage $V_{DD}-V_{SS}$ is also reduced. The N-channel MOS transistor N1 is turned off when the voltage $V_{DD}-V_{SS}$ is lower than the threshold voltage of the N-channel MOS transistor N1. As a result, a voltage at the node A1 is almost equal to the voltage $V_{DD}$. Then, the P-channel MOS transistor P1 is turned off and the N-channel MOS transistor N2 is turned on. A low-level voltage appears at the node A1. Accordingly, the inverter INV outputs a high-level voltage, and the level sifter LS shifts the level of the high-level voltage.

The source voltage detector 30 shown in FIG. 3 outputs a low-level power off signal $S_{off}$ while the device is activated, however, it outputs a high-level power off signal $S_{off}$ when the device is turned off, that is, it works as a power-off state detection circuit.

The voltage follower amplifier 215 amplifies the externally supplied reference voltage $V_{REF}$ with voltage-following amplification and outputs a voltage $V_0$ which will be a reference voltage for a later-described boosted voltage.

The switch SW9 is an N-channel MOS transistor which is turned on in response to the high-level power off signal $S_{off}$ from the source voltage detector 30. The switch SW9 pulls the voltage $V_0$ down to the ground voltage $V_{SS}$.

Figure 4:
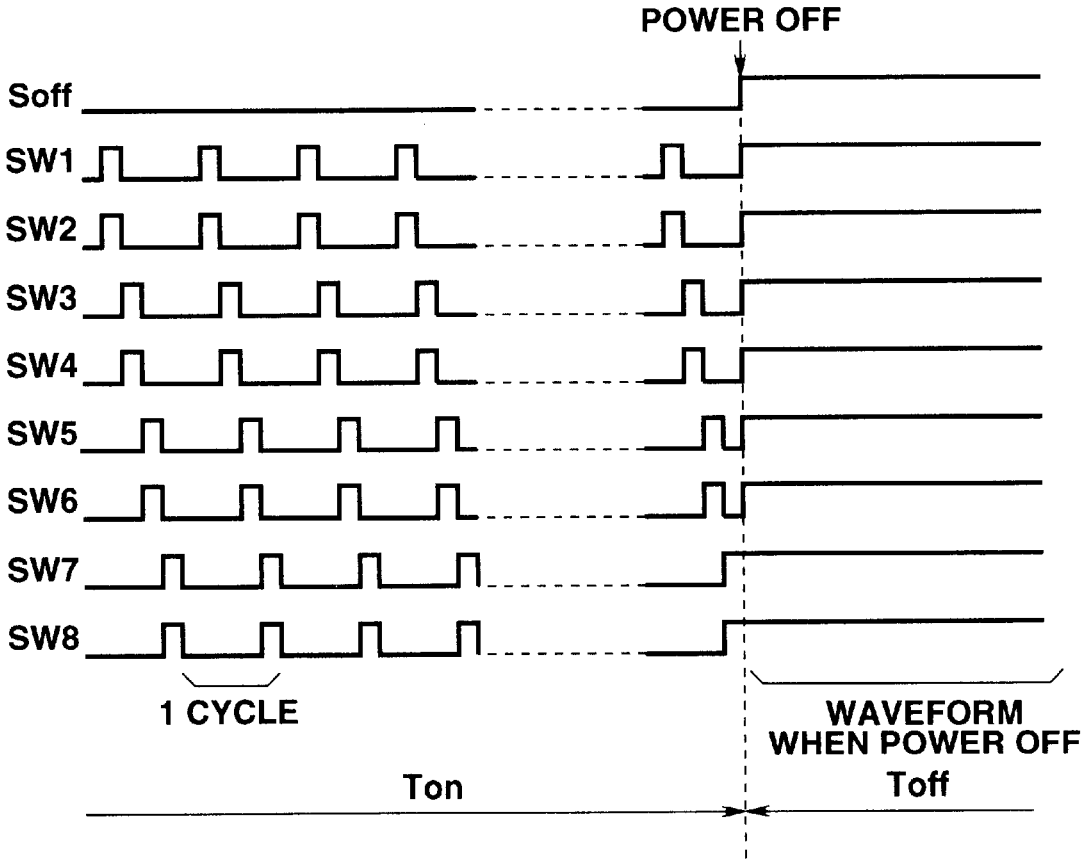
FIG. 4 is a timing chart indicating ON/OFF timings of switches SW1 to SW8 shown in FIG. 2.

The switch controller 213 turns on/off the switches SW1 to SW8 (which are semiconductor switches or the like) in accordance with a reference timing signal from the control circuit 27 while the device is activated. FIG. 4 shows on/off timings of the switches, and reference character $T_{on}$ denotes an on-state period of the device. As the switches SW1 to SW8 are switched, the connection among the capacitors CC and C1 to C4 are switched. As a result, boosted voltages $V_2$ to $V_4$ are generated.

The switch controller 213 outputs signals which turn the switches SW1 to SW8 to on-state during a termination period $T_{off}$ shown in FIG. 4 in response to a high-level power off signal $S_{off}$ from the source voltage detector 30.

A voltage (charged voltage) from both terminals of a later-described stabilizing capacitor CG in the low voltage circuit 220 is used as a voltage for driving the switch controller 213. The switch controller 213 is driven for a while even after the supply of the source voltage $V_{DD}$ is cut off, because the switch controller 213 is powered by the stabilizing capacitor CG with its charged electricity.

The low voltage circuit 220 comprises a constant voltage circuit 221 (which is a switching regulator or the like) for reducing the source voltage $V_{DD}$ down to a constant voltage $V_{CH}$ and outputting the reduced voltage, and the stabilizing capacitor CG connected between an output terminal of the constant voltage circuit 221 and a ground $V_{SS}$.

The low voltage circuit 220 supplies low drive voltages to the logic circuits and the like which do not need a high voltage. This function reduces power consumption at the drive control circuit 20.

The stabilizing capacitor CG of the low voltage circuit 220 is charged. The charges in the stabilizing capacitor CG are used for executing terminating operation for turning the LCD device 10 to non-display state after the power source supply is cut off.

The control circuit 27 shown in FIG. 1 controls timings of whole operations in the drive control circuit 20. The control circuit 27 is driven with low voltages $V_{CH}$ to supply a reference timing signal to the switch controller 213 while generating 2-bit voltage-switching signals Sc and Sd to be supplied to the scan drive circuit 25. The 2-bit voltage switching signals Sc and Sd are used for generating scan signals to be applied to the scan electrode array 13.

An operation of thus structured LCD device will now be described.

During an on-state period, the source voltage $V_{DD}$ is supplied to the drive control circuit 20, and the source voltage detector 30 outputs a low-level power off signal $S_{off}$. The switch controller 213 turns the switches SW1 and SW2 to on-state first, in accordance with the low-level power off signal $S_{off}$ and the timing signal from the control circuit 27. The timing chart shown in FIG. 4 indicates this first action of the switch controller 213 during the on-state period $T_{on}$. Then, the source voltage $V_{DD}$ and a reference voltage $V_1$ ($=V_0$) are applied to the charge carrier capacitor CC. As a result, the charge carrier capacitor CC is charged. The charged voltage is almost equal to a voltage $V_{DD}-V_1$.

Then, the switch controller 213 turns the switches SW1 and SW2 to off-state and turns the switches SW3 and SW4 to on-state. Thus, the boosting capacitor C2 is connected in parallel to a series circuit of the charge carrier capacitor CC and the boosting capacitor C1. A voltage between both terminals of the boosting capacitor C1 is $V_{DD}-V_1$. The boosting capacitor C2 is charged with a voltage which is almost $2\times(V_{DD}-V_1)$.

Then, the switch controller 213 turns the switches SW3 and SW4 to off-state and turns the switches SW5 and SW6 to on-state. Thus, the boosting capacitor C3 is connected in parallel to a series circuit of the charge carrier capacitor CC and the boosting capacitor C2. The boosting capacitor C3 is charged with a voltage which is almost $3\times(V_{DD}-V_1)$.

Then, the switch controller 213 turns the switches SW5 and SW6 to offstate and turns the switches SW7 and SW8 to on-state. Thus, the boosting capacitor C4 is connected in parallel to a series circuit of the charge carrier capacitor CC and the boosting capacitor C3. The boosting capacitor C4 is charged with a voltage which is almost $4\times(V_{DD}-V_1)$.

Repeated execution of the above sequence causes sequential distribution of the charges in the charge carrier capacitor CC to the boosting capacitors C2 to C4 with the voltage of $V_{DD}-V_1$ when the switches SW1 and SW2 are turned to on-state. Moreover, the charges are in the boosting capacitors C2 to C4, and the voltages $V_2(2\times V_{DD}-V_0)$, $V_3(3\times V_{DD}-2\times V_0)$ and $V_4(4\times V_{DD}-3\times V_0)$ are output. Those voltages are resultant voltages after the source voltage $V_{DD}$ is boosted.

The signal drive circuit 23 selects voltages from the voltages $V_{DD}$, $V_2$ and $V_4$ in accordance with the image signals Sa and Sb which represent gradations on the pixels forming an image to be displayed. The selected voltages are applied to the signal electrode array 11.

The scan drive circuit 25 selects voltages from the voltages $V_{DD}$, $V_3$, $V_4$ and $V_1$ in accordance with the voltage-switching signals Sc and Sd from the control circuit 27. The scan drive circuit 25 applies a select signal having predetermined waveform to its corresponding selected electrode in the scan electrode array 13 and a non-select signal having predetermined waveform to its corresponding non-selected electrode in the scan electrode array 13.

Accordingly, the drive control circuit 20 drives the LCD device 10 so as to display an image defined by the image signals Sa and Sb while being powered by the charge carrier capacitor CC, the boosting capacitors C1 to C4 and the stabilizing capacitor CG with their charged voltages during the on-state period.

When the source voltage $V_{DD}$ is cut off, the voltage in the source line is reduced down to be lower than the voltage $V_{DD}$. If the source voltage detector 30 detects that the voltage in the source line is reduced down to predetermined level, the source voltage detector 30 outputs a high-level power off signal $S_{off}$.

The switch SW9 is turned to on-state in response to the high-level power off signal $S_{off}$. The voltages $V_0$ and $V_1$ are shunted to the ground potential $V_{SS}$ and are reduced rapidly.

The operation of the switch controller 213 is maintained for a while even after the source voltage $V_{DD}$ is cut off, because the switch controller 213 is powered by the stabilizing capacitor CG with its charges (electric energy). The switch controller 213 turns the switches SW1 to SW8 to on-state in response to the high-level power off signal $S_{off}$ during an off-state period $T_{off}$ shown in FIG. 4.

The switches SW1 to SW8 are kept being on-state until the voltage $V_{CH}$ is reduced to be lower than the activation voltage of the switch controller 213. The operations of the switch controller 213 or the like cause drop of the voltage $VC_H$ by discharging the stabilizing capacitor CG. All the switches SW1 to SW9 are on-state while the operation of the switch controller 213 is maintained, the voltages $V_{DD}$, $V_0$ to $V_4$ are shunted to the ground potential $V_{SS}$, and most of the charges in the charge carrier capacitors C1 to C4 and the boosting capacitor CC are discharged.

As described in this embodiment, the LCD apparatus is powered by the capacitors C1 to C4, the boosting capacitor CC and the stabilizing capacitor CG so as to be driven during the on-state period. Immediately after the power supply is cut off, the apparatus uses charges (electric energy) in the stabilizing capacitor CG to perform termination process in order to turn off the LCD device 10 without irregular display.

That is, the charges which cause irregular display (bright lines or spots) are discharged from the capacitors C1 to C4 and the boosting capacitor CC while the apparatus is driven, that is, powered by the stabilizing capacitor CG. Moreover, making the output voltage be equal to the ground voltage $V_{SS}$ by inactivating the booster circuit 210 prevents a high voltage from being applied to the LC layer 15. Thus, irregular display such as bright lines or spots on the display screen caused by charges in the capacitors are prevented from appearing.

In the above described embodiment, the power source circuit 21 boosts the source voltage $V_{DD}$ in a plurality of phases to generate the plurality of different voltages $V_1$ to $V_4$ while being powered by the capacitors. The present invention may be employed in a power source circuit which divides a boosted voltage into drive voltages with capacitors. In this case, the boosted voltage is generated by boosting a source voltage $V_{DD}$.

Figure 5:
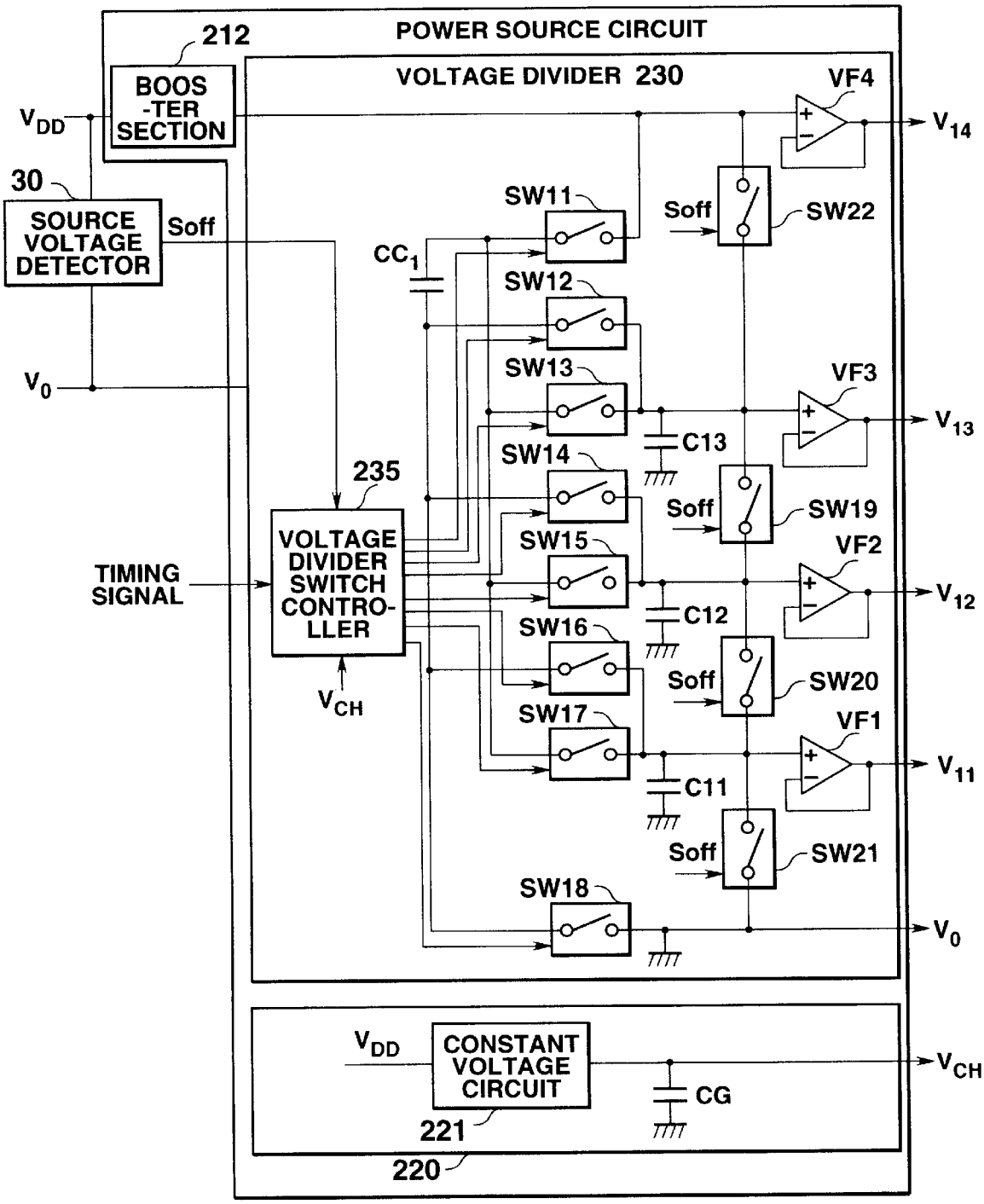
FIG. 5 is a diagram showing modification of the power source circuit shown in FIG. 2.

FIG. 5 exemplifies the power source circuit for this case which comprises the source voltage detector 30, a booster section 212, the low voltage circuit 220 and a voltage divider 230. The power source circuit outputs drive voltages $V_{14}$, $V_{13}$, $V_{12}$, $V_{11}$ ($V_{14}>V_{13}>V_{12}>V_{11}$) and a reference voltage $V_0(V_{11}>V_0)$.

The structures of the source voltage detector 30 and the low voltage circuit 220 shown in FIG. 5 are almost the same as that described in the above embodiment.

The booster section 212 has the generally known structure and boosts an externally supplied source voltage $V_{DD}$. A voltage $V_{pr}$, which is a boosted voltage through the booster section 212, is supplied to the voltage divider 230.

The voltage divider 230 divides the boosted voltage $V_{pr}$ from the booster section 212 into the drive voltages $V_{14}$, $V_{13}$, $V_{12}$ and $V_{11}$. The voltage divider 230 also generates the reference voltage $V_0$. As shown in FIG. 5, the voltage divider 230 comprises a voltage-divider switch controller 235, a charge carrier capacitor CC1, charging capacitors C11 to C13, voltage follower circuits VF1 to VF4 and switches SW11 to SW22.

Figure 6:
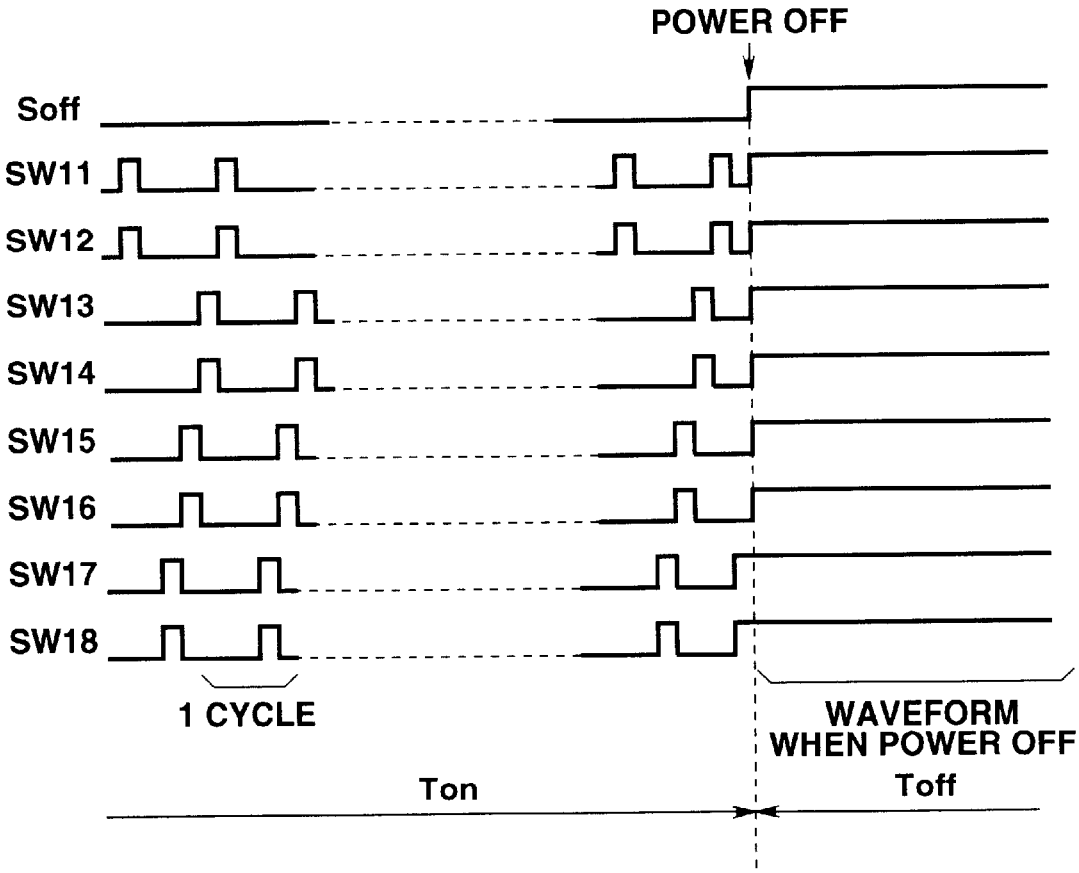
FIG. 6 is a timing chart indicating ON/OFF timings of switches SW1 to SW8 shown in FIG. 5.

The voltage-divider switch controller 235 controls the switches SW11 to SW18 (which are semiconductor switches, or the like) in accordance with an externally supplied timing signal while the apparatus is activated. FIG. 6 indicates on/off timings of the switches during the on-state period $T_{on}$. As the switches are controlled, connection among the capacitors CC1 and C11 to C13 is switched.

The voltage-divider switch controller 235 outputs a signal which turns the switches SW11 to SW18 to on-state during the off-state period $T_{off}$ shown in FIG. 6, when the source voltage detector 30 outputs a high-level power off signal $S_{off}$ indicating that the supplied voltage is reduced.

The voltage-divider switch controller 235 can be driven for a while even after the source voltage $V_{DD}$ is cut off, because it is powered by the stabilizing capacitor CG with its charged electricity.

As the switches SW11 to SW18 are turned to on-state or off-state, connection among the charge carrier capacitor CC1 and the charging capacitors C11 to C13 is sequentially switched. This switching sequence causes supply of charges from the capacitor CC1 to the charging capacitors C11 to C13.

Each of the charging capacitors C11 to C13 is charged with the voltage supplied from the charge carrier capacitor CC1, and supplies a voltage to its corresponding voltage follower circuit, that is, one of the voltage follower circuits VF1 to VF3.

In the case where the capacitors have the same electrostatic capacity, the voltage ratio for charging the capacitors C11, C12 and C13 is approximately 1:2:3. And they supply voltages to their corresponding voltage follower circuits VF1 to VF3 respectively.

Each of the voltage follower circuits VF1 to VF3 receives the voltage from its corresponding charging capacitor and amplifies it ×1 (impedance conversion). The amplified voltages are output as the drive voltages $V_{11}$ to $V_{13}$. The voltage follower circuit VF4 receives the boosted voltage $V_{pr}$ from the booster section 212 and amplifies it ×1 (impedance conversion). The amplified voltage is output as the drive voltage $V_{14}$.

Each of the switches SW19 to SW22 is, for example, an N-channel MOS transistor. They are turned to on-state in response to the high-level power off signal $S_{off}$ from the source voltage detector 30, and pull the voltages $V_{11}$, $V_{12}$ and $V_{13}$ down to the reference voltage $V_0$.

Operations of thus structured power source circuit will now be described.

Usually, the source voltage $V_{DD}$ is being supplied to the power source circuit. The supplied source voltage $V_{DD}$ is boosted by the booster section 212 and is supplied to the voltage divider 230 as the boosted voltage $V_{pr}$.

The source voltage detector circuit 30 outputs a low-level power off signal $S_{off}$. The voltage-divider switch controller 235 turns the switches SW11 and SW12 to on-state in accordance with the low-level power off signal $S_{off}$ and an externally supplied timing signal during on-state period $T_{on}$ shown in FIG. 6. As the switches SW11 and SW12 are turned to on-state, a series connection of the charge carrier capacitor CC1 and the charging capacitor C13 is formed. The charging capacitor C13 is charged with a voltage which is divided from the boosted voltage $V_{pr}$. The division ratio corresponds to the capacity ratio of the charge carrier capacitor CC1 and the charging capacitor C13.

Then, the voltage-divider switch controller 235 turns the switches SW11 and SW12 to off-state and turns the switches SW17 and SW18 to on-state. Thus, the charging capacitor C11 is connected in parallel to the charge carrier capacitor CC1. The charging capacitor C11 is charged with a voltage which is lower than that in the charge carrier capacitor CC1. The amount of the charge capacity of the capacitor C11 is determined in accordance with the ratio of the capacity of the charge carrier capacitor CC1 to a sum of the capacities of the capacitors CC1 and C11.

Then, the voltage-divider switch controller 235 turns the switches SW17 and SW18 to off-state, and turns the switches SW15 and SW16 to on-state. Thus, the charging capacitor C12 is connected in parallel to a series circuit of the charge carrier capacitor CC1 and the charging capacitor C11. The capacitor C12 is charged with a voltage which is higher than that in the capacitor C11. The charged voltage in the capacitor C12 is high because it is a sum of the charged voltages in the capacitor C11 and CC1.

Then, the voltage-divider switch controller 235 turns the switches SW15 and SW16 to off-state, and turns the switches SW13 and SW14 to on-state. Thus, the charging capacitor C13 is connected in parallel to a series circuit of the charge carrier capacitor CC1 and the charging capacitor C12. The capacitor C13 is charged with a voltage which is higher than that charged in the capacitor C12. The voltage charged in the capacitor C13 is high because it is a sum of the charged voltages in the capacitors C12 and CC1.

That is, the voltage-divider switch controller 235 controls the switches SW11 to SW18 to switch them in accordance with the on/off timings during the on-state period Ton shown in the timing chart of FIG. 6. More precisely, the charge carrier capacitor CC1 and the charging capacitor C13 are connected in series first. Thus, the capacitor CC1 is charged with a voltage which is lower than the boosted voltage $V_{pr}$. Then, the capacitor C11 is charged with the voltage charged in the capacitor CC1. The capacitors C12 is charged with a voltage which is the sum of the charged voltages in the capacitors C11 and CC1. In the same manner, a voltage which is the sum of the charged voltages in the capacitors C12 and CC1 is charged in the capacitor C13.

Such a switching sequence is repeated several times at high speed, the capacitors C11, C12 and C13 are sequentially charged with voltages, and their potential is kept being stable. The voltages to be charged in the capacitors C11, C12 and C13 depend on capacities of the capacitors C11, C12, C13 and CC1. For example, in the case where each of prepared capacitors C11, C12 and C13 has the same capacity and the capacity of the capacitor CC1 is three times as large as that of the capacitor C13, the capacitor C11 is charged with a voltage of approximately $V_{pr}/4$, the capacitor C12 is charged with a voltage of approximately $(2\times V_{pr})/4$ and the capacitor C13 is charged with a voltage of approximately $(3\times V_{pr})/4$, eventually after the above described switching sequences. That is, the boosted voltage $V_{pr}$ is divided into four voltages.

The voltages charged in the capacitors C11 to C13 are subjected to impedance conversion by the voltage follower circuits VF1 to VF3. The converted voltages are output as drive voltages $V_{11}=(V_{pr}/4)$, $V_{12}=((2\times V_{pr})/4)$ and $V_{13}=((3\times V_{pr})/4)$. The boosted voltage Vpr from the booster section 212 is subjected to impedance conversion by the voltage follower circuit VF4. The converted voltage is output as a drive voltage $V_{14}=((4\times V_{pr})/4)$.

When the source voltage $V_{DD}$ is cut off, the voltage in the power source line is reduced down to be lower than the voltage $V_{DD}$. If the reduced voltage reaches predetermined level, the source voltage detector 30 detects it and outputs a high-level power off signal $S_{off}$.

In response to the output high-level power off signal $S_{off}$, the switches SW19 to SW22 are turned to on-state, and the voltages $V_{14}$, $V_{13}$, $V_{12}$ and $V_{11}$ are shunted to the reference voltage $V_0$.

Even after the source voltage $V_{DD}$ is cut off, the voltage-divider switch controller 235 keeps its operation for a while because it is powered by the stabilizing capacitor CG with its charges (electric energy). During this period, the voltage-divider switch controller 235 turns the switches SW11 to SW18 to on-state in response to the high-level power off signal $S_{off}$. FIG. 6 indicates the on-timings of those switches during the off-state period.

The switches SW11 to SW18 are kept being in on-state until the voltage $V_{CH}$ is reduced down to be lower than the drive voltage of the voltage-divider switch controller 235. The operations of the voltage-divider switch controller 235 or the like cause the drop of the voltage $V_{CH}$ by discharging the stabilizing capacitor CG. During this phase, all of the switches SW11 to SW22 are in on-state, therefore, the voltages $V_{11}$ to $V_{14}$ are shunted to the reference voltage $V_0$ and most of the charges in the capacitors C11 to C13 and CC1 are discharged.

The above described power source circuit is powered by the capacitors C11 to C13, CC1 and CG so as to be driven during the on-state period. During the off-state period, the power source circuit is powered by the capacitor CG with its charges (electric energy) to execute the termination processing which is performed in order to terminate the display operation of the LCD device 10 without irregular display.

Thus, the irregular display, such as appearance of bright lines or spots on the display screen, which is caused by charges in the capacitors, is prevented from occurring.

The present invention is not limited to the above embodiments, but may be modified as needed.

In the above embodiments, the following steps are taken. Discharging the capacitors, terminating the boost operation to reduce the boosted voltages and to terminate the output of the boosted voltages, and selecting a non-boosted voltage as a voltage to be applied. Those steps are performed in order to prevent irregular display during the off-state period from occurring and terminate display operation without occurrence of the irregular display. However, only one of those steps may be taken to realize the objects.

In addition to the irregular display prevention means described in the above embodiment, the present invention may realizes the irregular display prevention by applying to the LC layer 15 voltages which are substantially OV or voltages which do not cause reaction of the LC layer 15.

The structure and operations of a signal drive circuit 23 and a scan drive circuit 25 provided for the above processing will now be described.

Figures 7A, 7B:
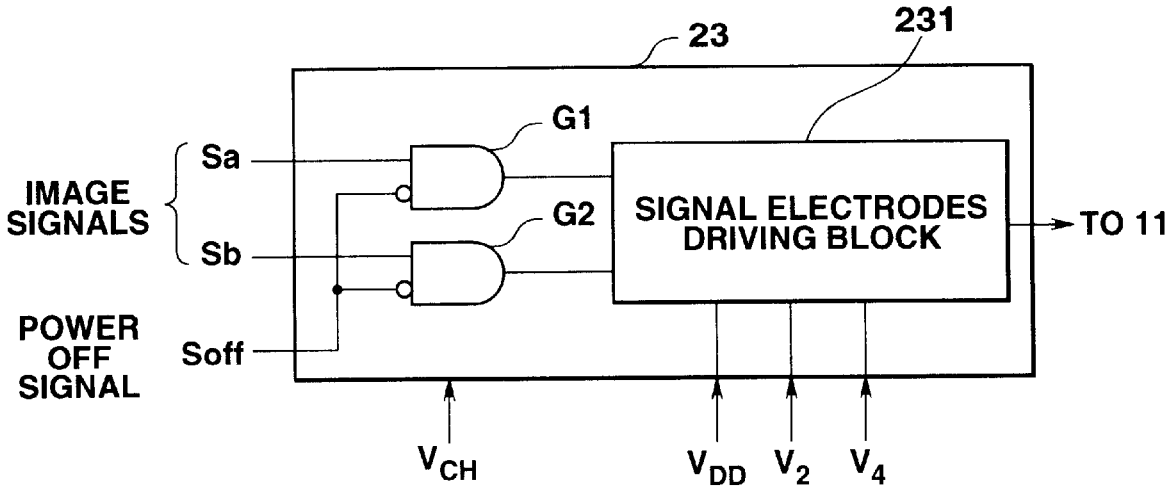
FIGS. 7A and 7B are block diagrams showing the structure of a signal drive circuit shown in FIG. 1.

As shown in FIG. 7A, the signal drive circuit 23 comprises gate circuits G1 and G2 and a signal electrode driving block 231. 2-bit image signals (gradation signals) Sa and Sb, the power off signal $S_{off}$, the source voltage $V_{DD}$, the low voltage $V_{CH}$, and the boosted voltages $V_2$ and $V_4$ are input to the signal drive circuit 23. The signal drive circuit 23 is driven with the low voltage $V_{CH}$, and selects voltages from the voltages $V_{DD}$, $V_2$ and $V_4$ based on the logic shown in FIG. 7B. The selected voltages are applied to corresponding electrodes in the signal electrode array 11.

Figures 8A, 8B:
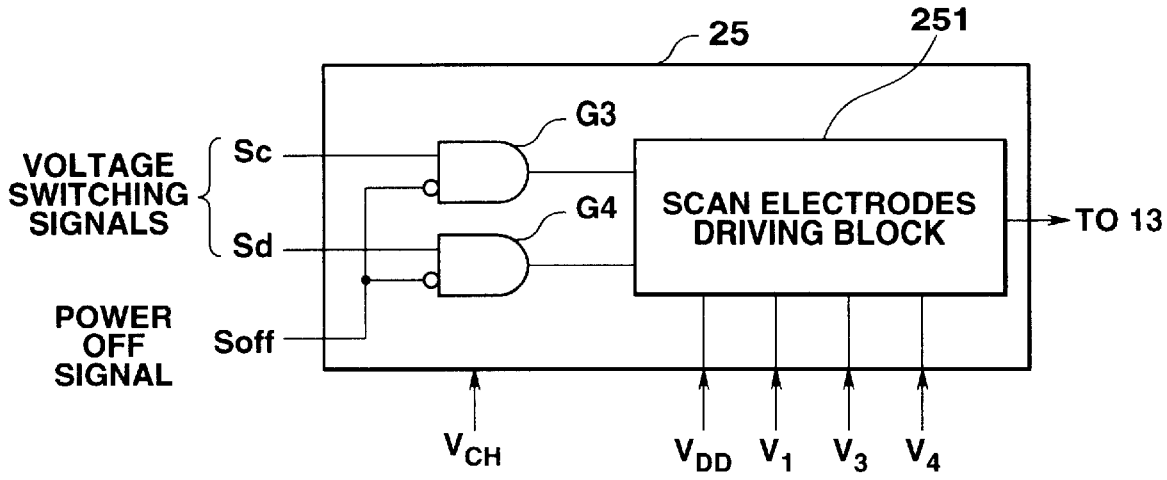
FIGS. 8A and 8B are block diagrams showing the structure of a scan drive circuit shown in FIG. 1

As shown in FIG. 8A, the scan drive circuit 25 comprises gate circuits G3 and G4, and a scan electrode driving block 251. 2-bit voltage-switching signals Sc and Sd, the power off signal $S_{off}$, the source voltage $V_{DD}$, the low voltage $V_{CH}$, and the boosted voltages $V_1$, $V_3$ and $V_4$ are input to the scan drive circuit 25. The scan drive circuit 25 is driven with the low voltage $V_{CH}$. The voltages $V_{DD}$, $V_1$, $V_3$ and $V_4$ are applied to their corresponding electrodes in the scan electrode array 13 respectively based on the logic shown in FIG. 8B.

During the on-state period, the gate circuits G1 and G2 of the signal drive circuit 23 are opened because the power off signal $S_{off}$ is a low-level signal, and the image signals Sa and Sb are supplied to the signal electrode driving block 231. The image signals Sa and Sb are 2-bit signals representing display gradations. The signal electrode driving block 231 sequentially selects voltages from the voltages $V_{DD}$, $V_2$ and $V_4$ corresponding to the display gradations in accordance with the image signals Sa and Sb, and the selected voltages are applied respectively to their corresponding electrodes in the signal electrode array 11.

In the scan drive circuit 25, the gate circuits G3 and G4 are opened, and the voltage-switching signals Sc and Sd are supplied to the scan electrode driving block 251.

Control circuit 27 outputs the voltage-switching signals Sc and Sd which are switched at constant cycle. Those signals generate select signals or non-select signals. The scan electrode driving block 251 sequentially switching the voltages $V_{DD}$, $V_3$, $V_4$ and $V_1$ in accordance with the voltage-switching signals Sc and Sd, and applies the voltages respectively to their corresponding electrodes in the scan electrode array 13. Thus, the scan electrode driving block 251 applies the select signals having predetermined waveform to the electrodes in the scan electrode array 13 to be selected, and applies the non-select signals having predetermined waveform to the electrodes in the scan electrode array 13 no to be selected.

When the source voltage $V_{DD}$ is cut off, the power off signal $S_{off}$ becomes a high-level signal. Thus, the gate circuits G1 to G4 are closed and they output low-level signals. Both the signal electrode driving block 231 and the scan electrode driving block 251 apply the source voltage $V_{DD}$ to the signal electrode array 11 and the scan electrode array 13. That is, the voltages applied between opposing electrode arrays 11 and 13 are fixed to the same voltage. As a result, none of the pixels are lit because the voltages applied to the LC layer 15 are substantially 0V.

As described in the above embodiment, the signal drive circuit 23 and the scan drive circuit 25 select the source voltage $V_{DD}$ which is a non-boosted voltage, moreover, the same voltages are applied to the signal electrode array 11 and the scan electrode array 13 in order to apply voltages of substantially 0V to the LC layer 15. As a result, the LCD device is in off-state, thus, the irregular display is prevented from occurring.

The voltages to be applied to the signal electrode array 11 and the scan electrode array 13 may not be fixed. Arbitral voltages having no potential difference may be applied to the signal electrode array 11 and the scan electrode array 13.

All of the above described means for providing the irregular display from appearing on the display screen may be performed.

In the above described embodiment, both terminals of each of the capacitors CC and C1 to C4 are shunted in order to discharge those capacitors. Discharging method in the present invention is not limited to the method described in the above embodiment, but various methods for reducing the charges in the capacitors may be employed.

For example, both terminals of each of the capacitors may be shunted via a resistive load which is provided for consuming the charged energy.

Figure 9:
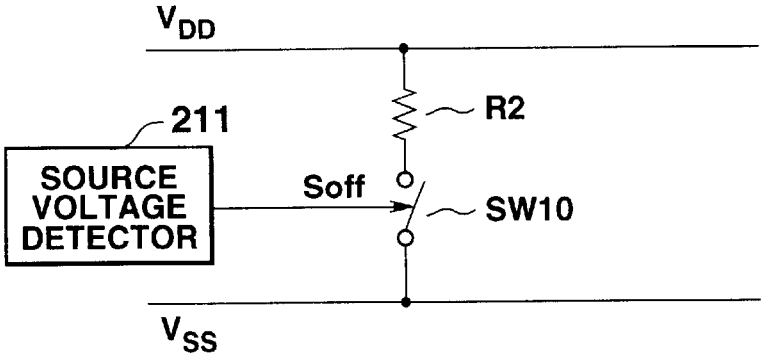
FIG. 9 is a diagram showing the structure for reducing a source voltage when the device is turned off.

Reducing or cutting off the source voltage $V_{DD}$ while the booster circuit 210 is being driven after the power off consumes the charges in the capacitors CC and C1 to C4 gradually, thus, the boosted voltage is also reduced. A resultant effect is the same as that described in the above embodiments. For example, FIG. 9 shows a circuit having a resistor R2 and a switch SW10 connected in series between the power source line $V_{DD}$ and the ground line $V_{SS}$. The voltage at the power source line $V_{DD}$ may be reduced gradually by turning the switch SW10 to on-state with a high-level power off signal $S_{off}$ from the source voltage detector 30. In this case, the switch controller 213 continues controlling the switches SW1 to SW8 with the low voltage $V_{CH}$, regardless of the level of the power off signal $S_{off}$.

In the above described embodiment, the voltages for the signal electrode array 11 and the scan electrode array 13 are fixed during the off-state period, however, voltages having no potential difference, that is, voltages which do not cause the reaction of the LC layer 15 (does not cause the LC layer 15 to be lit) may be applied to the electrode arrays. Such potential difference depends on device's ability. Suitable voltages to be applied may be obtained through an experiment or the like.

In the case where a voltage (threshold) which causes the reaction of the LC layer 15, for example, is larger than the voltage "$V_{DD}-V_1$", a voltage to be applied to the LC layer 15 is $V_3-V_2$ (which is almost equal to a voltage $V_{DD}-V_1$) after the boosted voltage $V_2$ is applied to the signal electrode array 11 and the boosted voltage $V_3$ is applied to the scan electrode array 13. This prevents the LC device 10 from being lit.

The connection among the capacitors CC and C1 to C4 is switched before and after the power off. The speed of switching the connection after the power off may be lower than that before the power off.

Figure 10A:
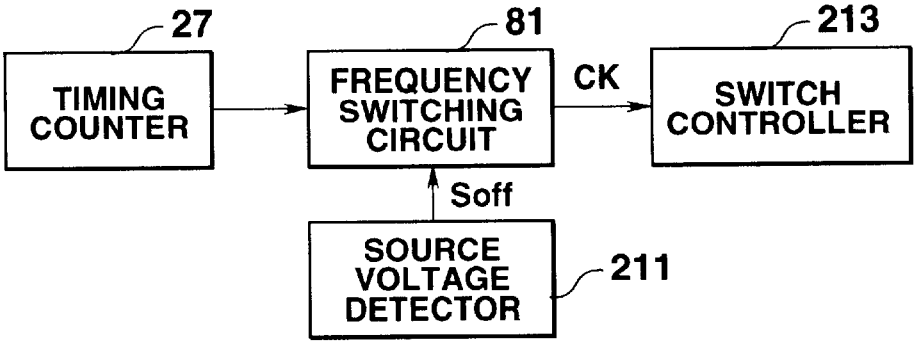
FIG. 10A is a block diagram of circuit connection showing the structure for reducing frequency of a clock signal which is provided for reducing a boosted voltage of a booster circuit when the device is turned off.
Figure 10B:
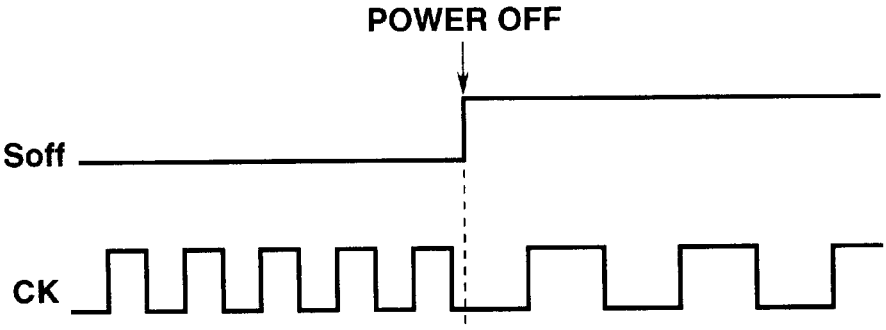
FIG. 10B is a timing chart showing the state where clock frequency is reduced when the device is turned off.

In this case, the power source circuit 21 has a frequency switching circuit 81 as shown in FIG. 10A. As shown in FIG. 10B, the frequency switching circuit 81 supplies a clock signal CK to the switch controller 213 in accordance with a timing signal from the control circuit 27 during the onstate period. The clock signal CK is a signal for switching the connection among the capacitors CC and C1 to C4. When the power supply is cut off, the frequency switching circuit 81 receives a high-level power off signal $S_{off}$ from the source voltage detector 30. In response to the high-level power off signal $S_{off}$, the frequency switching circuit 81 starts to supply the clock signal CK whose frequency is lower than that of the clock signal CK during the on-state period to the switch controller 213.

This structure brings reduction of charges to be distributed to the boosting capacitors C1 to C4 from the charge carrier capacitor CC at a unit of time period after the power off. Therefore, the boosted voltages after the power off is lower than those during the on-state period. As a result, the charges in the capacitors CC and C1 to C4 after the power off are smaller than those during the on-state period, and the display termination is done without the occurrence of the irregular display.

Generally, a command for turning off the LC device 10 (display-off command) is supported by an LC device driving LSI (large scale integration). Such an LSI updates a value in an incorporated register for display on/off when it receives the display-off command, and turns off the display in accordance with the updated value of the register.

Figure 11:
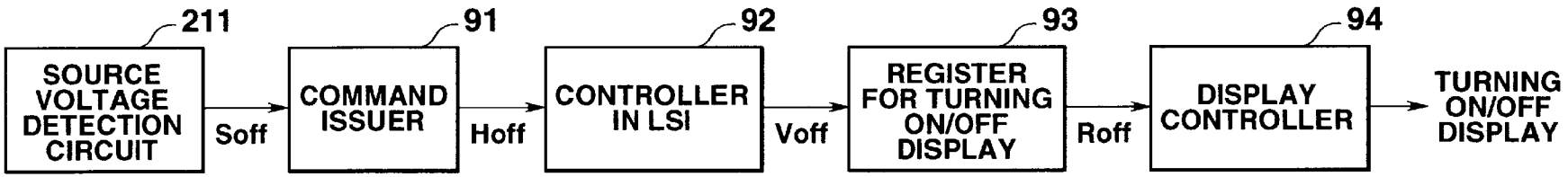
FIG. 11 is a block diagram exemplifying a case where a driving LSI comprising a register provided for switching on/off of display.

A command issuer 91 which issues a display-off command in response to a power off signal $S_{off}$ may be used with the LSI as shown in FIG. 11. In this case, the command issuer 91 issues the display-off command in accordance with the high-level power off signal $S_{off}$ when the source voltage $V_{DD}$ is reduced. A controller 92 in the LSI updates a value in a register 93 for turning on/off the display in response to the display-off command. The updated value indicates "display-off", and a display controller 94 turns off the display in accordance with the updated register value. This structure also realizes the display termination without occurrence of the irregular display.

The structure of the source voltage detector 30 is not limited to the structure shown in FIG. 3, but may be modified as needed. An arbitral structure which can detect that the source voltage is reduced down to be lower than the reference level may be employed.

The exemplified display device in the above embodiment is the simple-matrix LCD device 10, however, an arbitral display device may be employed. For example, an active-matrix LCD device such as TFT or MIM may be used. When such a device is used, steps to be taken during the off-state period are the same as those described in the above embodiment, that is, discharging the capacitors, stop boosting, selecting the non-boosted voltage, and applying voltages (whose difference does not exceed a threshold voltage) between a pixel electrode array and a common electrode array.

The structures of the signal drive circuit 23, the scan drive circuit 25, the control circuit 27 and the like may also be modified as needed. Digital signals having 3 or more bits, or analog signals may be used as the image signals.

The driving circuit of the present invention may be used for not only the LCD device but for a PDP (plasma display panel), an EL (electroluminescent) display, an FED (field emission display), or the like. In other words, the driving circuit of the present invention may be used for a display device in which capacitors generate drive voltages and charges in the capacitors may cause irregular display during the off-state period.

As described in the above, the present invention prevents irregular display from appearing on a display screen during an off-state period, thus, the display operation is terminated without occurrence of the irregular display.

What is claimed is:

1. A circuit for driving a display device comprising:

drive voltage generating means including:

a plurality of switching devices, a plurality of capacitors which are charged with a plurality of different voltages based on supplied electricity, by switching connection of said plurality of switching devices, control means for controlling said plurality of switching devices, and outputting means for outputting the voltages charged into said plurality of capacitors, and said drive voltage generating means selectively performing:

an operation for generating and outputting a plurality of drive voltages for driving a display device with the supplied voltages in accordance with control of said control means controlling said plurality of switching devices, and a process for generating and outputting at least one voltage for controlling the display device not to light;

drive means for driving the display device with the plurality of drive voltages output by said drive voltage generating means; and power-off state detection means for detecting that the electricity to said drive voltage generating means is cut off, and for outputting a detection signal for controlling said drive voltage generating means to execute power-off processing, wherein said control means includes discharge control means for discharging said capacitors in response to the detection signal from said power-off state detection means.

2. The circuit for driving the display device according to claim 1, further comprising charge means in which electricity is charged, wherein said drive voltage generating means executes the predetermined power-off processing with the electricity charged in said charge means in response to the detection signal from said power-off state detection means.

3. The circuit for driving the display device according to claim 1, wherein said discharge control means connects both terminals of each of said capacitors, or connects both terminals of said capacitors via a resistive load.

4. The circuit for driving the display device according to claim 1, wherein said discharge control means fixes a voltage of at least one terminal of each of said capacitors to a predetermined voltage in response to the detection signal from said power-off state detection means.

5. The circuit for driving the display device according to claim 1, wherein said drive voltage generating means comprises:

boost means for boosting a supplied voltage and outputs boosted voltages as the drive voltages; and control means including means for controlling said boost means to terminate the outputs of the boosted voltages.

6. The circuit for driving the display device according to claim 1, wherein said drive voltage generating means comprises:

boost means for boosting a supplied voltage and outputs boosted voltages as the drive voltages; and control means including means for controlling said boost means to reduce the boosted voltages.

7. The circuit for driving the display device according to claim 1, wherein said drive voltage generating means comprises boost means for boosting the supplied voltage and outputting the boosted voltage, and means for dividing the boosted voltage from said boost means and controlling said boost means to terminate the output of the boosted voltage in response to the detection signal from said power-off state detection means.

8. The circuit for driving the display device according to claim 1, wherein said drive voltage generating means comprises boost means for boosting the supplied voltage and outputting the boosted voltage, and means for dividing the boosted voltage from said boost means and controlling said boost means to reduce the boosted voltage in response to the detection signal from said power-off state detection means.

9. The circuit for driving the display device according to claim 1, wherein said drive means comprise power-off processing means for generating, in response to the detection signal from said power-off state detection means, voltages which cause the display device not to light and for supplying the generated voltages to said display means.

10. The circuit for driving the display device according to claim 1, wherein the display device lights when a voltage which is applied between opposing two electrodes is equal to or greater than a threshold voltage, and said drive means comprises means for applying a voltage which is smaller than the threshold voltage between said opposing two electrodes in response to the detection signal from said power-off state detection means.

11. The circuit for driving the display according to claim 1, wherein said drive voltage generating means comprises means for reducing an externally supplied voltage when said power-off state detection means detects that the supply of electricity is cut off.

12. A method for driving a display device with electricity charged in capacitors, said method comprising the steps of:

charging a plurality of capacitors for retaining a voltage with a plurality of different voltages, by switching connection of a plurality of switching devices upon reception of electricity;

outputting a voltage charged into said plurality of capacitors in a form of a plurality of drive voltages for driving a display device to a driving circuit, and driving the display device; and performing a process for generating and outputting, to the driving circuit, at least one voltage for controlling the display device not to light, using an electric charge charged into a charge means for charging electricity, when it is detected that power supply is cut off, and executing predetermined processing for discharging said capacitors so as to output a voltage to said driving circuit for controlling the display device not to light.

* * * * *